US006994121B2

(12) United States Patent
Burton

(10) Patent No.: US 6,994,121 B2
(45) Date of Patent: Feb. 7, 2006

(54) CARPET WEAVING LOOM

(75) Inventor: Michael Winspear Burton, West Midlands (GB)

(73) Assignee: Brintons Limited, Kidderminster (GB)

( * ) Notice: Subject to any disclaimer, the term of this patent is extended or adjusted under 35 U.S.C. 154(b) by 236 days.

(21) Appl. No.: 10/276,678

(22) PCT Filed: May 11, 2001

(86) PCT No.: PCT/EP01/05399

§ 371 (c)(1),
(2), (4) Date: Nov. 14, 2002

(87) PCT Pub. No.: WO02/00978

PCT Pub. Date: Jan. 3, 2002

(65) Prior Publication Data

US 2003/0145897 A1 Aug. 7, 2003

(30) Foreign Application Priority Data

May 15, 2000 (EP) ..... 00304082

(51) Int. Cl.
*D03D 39/00* (2006.01)

(52) U.S. Cl. ..... 139/7 A

(58) Field of Classification Search ..... 139/7 A, 139/2, 7 R, 8–10, 7 B, 7 C, 7 D, 7 E
See application file for complete search history.

(56) References Cited

U.S. PATENT DOCUMENTS

| | | | | |
|---|---|---|---|---|
| 2,954,805 | A * | 10/1960 | Wilkesmann | 139/7 B |
| 5,743,306 | A * | 4/1998 | Stewart et al. | 139/7 A |
| 6,220,307 | B1 * | 4/2001 | Griffith | 139/7 A |
| 6,293,314 | B1 * | 9/2001 | Dewispelaere | 139/7 A |
| 6,701,970 | B2 * | 3/2004 | Burton | 139/7 A |
| 6,820,656 | B2 * | 11/2004 | Burton | 139/7 A |

FOREIGN PATENT DOCUMENTS

| | | | | |
|---|---|---|---|---|
| DE | 15 35 755 B | | 1/1970 | |
| EP | 0 058 478 A | | 8/1982 | |
| GB | 1075082 | * | 7/1967 | 139/7 A |
| GB | 2 190 107 A | | 11/1987 | |
| WO | WO 95 31594 A | | 11/1995 | |
| WO | WO 01 88240 A | | 11/2001 | |

* cited by examiner

*Primary Examiner*—Danny Worrell
(74) *Attorney, Agent, or Firm*—Sughrue Mion, PLLC

(57) ABSTRACT

A carpet weaving loom comprises one or more tuft forming units (1), each of which is capable of supplying yarn tufts (26) of a number of different colors to a number of different weaving points sequentially. The or each of the turf forming units (1) includes a demountable yarn carrier (2). In this way, when it is required to change the design of carpet being woven, or the creel (3) is exhausted, the or each yarn carrier (2) is simply replaced by another fed from a different creel (3). Preferably the creel (3) associated with the or each set of yarn carriers is itself removable from the remainder (6) of the loom and replaceable with the yarn carriers (2).

15 Claims, 9 Drawing Sheets

CARPET WEAVING LOOM

BACKGROUND TO THE INVENTION

In making carpet, particularly patterned Axminster carpet, a yarn tuft forming unit is used to provide yarn of a particular colour to each weaving point of the carpet. In conventional Axminster weaving there are two principal ways which the yarn tuft formation is carried out. The first way is on a Jacquard Axminster loom, and the second is on a spool Axminster loom.

On a gripper Jacquard Axminster loom each weaving point includes a yarn carrier which is normally fed by eight yarns usually of different colour and the Jacquard mechanism moves the carrier to bring a selected yarn to the yarn selection position. A gripper moves towards the carrier, grips the yarn at the yarn selection position then relative movement apart of the gripper and the carrier pulls a predetermined length of yarn from the carrier. The yarn is then cut to form a tuft and moved by the gripper to the weaving point. The tuft carried by the gripper is of the appropriate colour for the tuft to be supplied to the next row of carpet to be woven. For a conventional 12 foot (4 m) loom there are over a 1000 weaving points across the loom and thus the creel supplying yarn to the loom has to have the potential of carrying over 8000 yarn packages. Typically, when the creel includes measured quantities of yarn in each yarn package, an allowance of an additional eighteen meters of yarn is provided in each yarn package. Accordingly the greater the number of yarn packages the greater the wastage. A creel of such size occupies a substantial area and such a loom takes a considerable time to "thread up" as over 8000 yarn ends have to be fed through the creel and to the individual yarn carriers. In spite of such a large creel size a designer of such carpets is relatively limited since the number of colours available for each column of tufts extending in the warp direction of the finished carpet and corresponding to a single weaving point is limited to only eight throughout each pattern repeat. Jacquards are also known in which the yarn carrier can hold sixteen different yarns. These require an even larger creel which takes even longer to thread up.

Spool Axminster looms provide a designer with greater flexibility. In spool Axminster looms a separate spool is provided for each row of the pattern repeat and each spool has a separate yarn winding for each weaving point along each row. Therefore, at least theoretically, the designer has an infinite number of colour choices for each column and row of each pattern repeat. However, in practice, as the number of colour choices used for each column and row of the design increases, the number of yarn packages needed for the spool winding operation also increases. Further, the spool winder must be threaded up differently for the winding of each spool which is time consuming. When a large number of different colours are used in both the column and row or warp and weft direction of each pattern repeat the number of different coloured yarn packages supplying the spool winder can be even larger than those on a creel of a typical Jacquard Axminster loom. The pattern repeat on spool looms is limited by the number of spools available in the spool chain. Further, there is considerably greater yarn wastage from a spool Axminster loom than a gripper Axminster loom because, on completion of a run, waste is generated from each weaving point of each row of the pattern repeat.

DISCUSSION OF PRIOR ART

In both the Jacquard and spool Axminster looms a row of tufts for a complete row of the carpet is created simultaneously and transferred to the weaving point at which they are woven into a backing to produce the carpet. An entirely different approach to yarn selection for carpet production has recently been proposed in WO 95/31594. In this, it is proposed that tufts of yarn to form a row of the carpet are produced by first loading yarn tufts into a tuft carrier and then transferring the yarn tufts from the tuft carrier to the weaving points. To achieve this a large number of different tuft forming units, typically one per weaving point, are provided along the length of a path with typically each tuft forming unit being supplied with yarn of only a single colour. As the tuft carrier is moved along the path it receives tufts of appropriate colour in each of its tuft holding sites. The tuft carrier is subsequently moved so that all the tufts for each row can be gripped by grippers and transferred to the weaving point simultaneously. Thus, the tufts are not usually all formed simultaneously and hence the tuft formation is, at least to some extent, decoupled from the weaving operation. Therefore, tuft formation can take place at the same time as the weaving operation and thus tuft formation can take place substantially continuously throughout the operation of the loom. This is to be contrasted with the conventional spool or gripper type looms where tuft formation takes place over only about half of each weaving cycle.

In examples given in WO 95/31594 it is suggested that partly as a result of forming the tufts throughout the entire weaving cycle it is possible to, for example, increase the speed of the tuft forming operation by four times. It is also explained that if this were possible and it was intended to operate the loom at the same speed as a conventional loom then it would be possible to reduce the size of its creel by a quarter since, in effect, each tuft forming unit would supply tufts for four weaving points. However, nowhere in this document does it exemplify an arrangement in which there are less yarn packages than the number of weaving points and so even this arrangement requires a substantial creel and a substantial time to thread up the loom during which no carpet production takes place.

In WO 01/88240, a carpet weaving loom is described which includes one or more tuft forming units, the or each of which supplies tufts to a large number of weaving points, typically a number of tens of weaving points, sequentially. A loom, particularly one for producing samples may have only a single tuft forming unit and this may supply tufts for three hundred or more weaving points. Typically, for carpet production the loom includes a plurality of tuft forming units and each supplies tufts for between thirty and one hundred weaving points. With such an arrangement a great reduction in the number of yarn packages in the creel is obtainable since the potential number of yarn packages is that needed conventionally divided by the number of weaving points supplied by the or each tuft forming unit so reducing it to below one hundred in some instances, whilst also giving the designer a greater number of colour choices in each column of tufts extending in the warp direction.

SUMMARY OF THE INVENTION

According to this invention a carpet weaving loom comprises one or more tuft forming units, each of which is capable of supplying yarn tufts of a number of different colours to a number of different weaving points sequentially, characterized in that the or each of the tuft forming units includes a demountable yarn carrier.

The yarn supplies for the or each demountable yarn carrier are provided from a creel which may be fixed in position and formed in two parts. In this case yarn from one part is threaded through guides and into the one or more demountable yarn carriers associated with the tuft forming units on the loom. When it is required to change the design of carpet to be woven, or when the creel is exhausted, the or each of the demountable yarn carriers are removed from the loom and merely replaced by different yarn carriers which are fed from yarn in the other part of the creel. The two parts of a fixed creel are preferably located side-by-side but they may also be located one behind the other.

Preferably however the or each demountable yarn carrier is supplied with yarn from a creel which is itself removable from the remainder of the loom and replaceable when the design of carpet to be woven changes or the creel is exhausted. It may be desirable to move the creel using equipment such as fork-lift truck but, preferably, the creel is mounted on wheels so that it can be wheeled towards and away from the remainder of the loom, typically manually. It is of course possible to split the creel into a number of units each of which supplies yarn to one or more of the tuft forming units but preferably the entire creel is formed as a single unit supplying the or all of the tuft forming units.

With the arrangement in accordance with this invention the yarn can be supplied to the creel and threaded through guides and into the or each demountable yarn carrier whilst the loom, using a different set of yarn carriers and a different creel or a different part of the creel, is weaving carpet. By being able to thread up the creel guides and yarn carriers either away from the loom or, in any event, whilst the loom is already producing carpet, there is effectively no need for any significant downtime in carpet production when changing from one design of carpet to the next or when changing the creel once it is exhausted. All that is required is to remove the yarn carrier from the or each tuft forming unit and replace it by another yarn carrier or carriers which are already threaded up with yarn from a different supply, then, immediately, the loom is once again ready to produce carpet but, typically, carpet of a different design such as a different pattern or colour.

Preferably the creel is located behind the weaver, that is to say it is located on the opposite side of the loom from the warp thread entry and shedding arrangements. This is unusual because in conventional carpet weaving looms the creel is on the same side of the loom as the warp thread entry and shedding arrangements and so is located "behind" the loom and in front of the weaver. When the creel is located in front of the loom, guides are preferably arranged to carry the yarns over the top of the weaver's position. The guides may be formed by a series of thread carrying eyes and/or all or part of the guides may be formed by conventional yarn tubes. This is particularly useful when the yarn passes over the top of the weaving position since the tubes protect the weaver from yarn debris. When the loom includes a movable creel the guides are preferably attached to and move with the creel.

The creel may include a number of package holders each of which supports the bobbin of a conventional yarn package or, alternatively, the creel may include a number of individual containers or cells each of which contains a length of yarn and accordingly be generally similar to that described in our earlier specification EP-A-0058478. Preferably the yarn supplies on the creel are of a predetermined length matched to those required for the particular design of carpet to be woven.

The or each yarn tuft forming unit preferably includes means to drive the yarn carrier into a selected one of a number of discrete positions to bring a selected yarn to a loading position, a puller for engaging the selected yarn at the loading position and pulling a predetermined length of the selected yarn from the selector wheel, and a cutting mechanism to cut the selected yarn to form a tuft of predetermined length.

Each yarn carrier may carry yarns of different colour spaced apart in the longitudinal direction of the yarn carrier, and means to drive the yarn carrier in the longitudinal direction to select yarn of a particular colour. Thus, the yarn carrier may be generally similar to that used on a conventional gripper Axminster loom but, in this case, it is preferred that the yarn carrier is moved longitudinally by, for example, a servomotor under computer control such as is described in EP-A-0785301. Preferably however, the or each tuft forming unit includes a yarn selector wheel with provision for holding a number of different yarns arranged around it and means to move the selector wheel into a selected one of a number of angularly discrete positions. The yarns may be arranged around the periphery of the selector wheel and extend in a direction generally parallel to its axis of rotation, but, preferably the yarns extend generally radially to the periphery of the wheel. Typically, such a yarn selector wheel has provision for containing more than 10 different yarns and typically 12, 16, 24 or 32 different yarns. Preferably the selector wheel is driven into and between its predetermined angular positions by a servomotor under the control of a computer. A particular example of such a tuft forming unit is described in detail in a International Patent Application No. PCT/EP01/05397 filed on the same date as the present application, claiming priority from European Patent Application No. 00304053.2.

Preferably the or each yarn carrier is demountable from the remainder of the or each tuft forming unit without the use of tools of any kind. The yarn carrier preferably includes engagement means which cooperate with the means to drive the yarn carrier to ensure that the yarn carrier responds to movement of the drive means and a retainer to hold the yarn carrier in position. The retainer may be a simple press-on or snap-on fitting including, for example, a spring loaded detent to hold the yarn carrier in position. Alternatively, the retainer may include a positive lock or latch operated by, for example, a lever, positively to lock the yarn carrier into position.

BRIEF DESCRIPTION OF THE DRAWINGS

A particular example of a loom in accordance with this invention will now be described with reference to the accompanying drawings in which.

DESCRIPTION OF PARTICULAR EMBODIMENT

Figure 1:
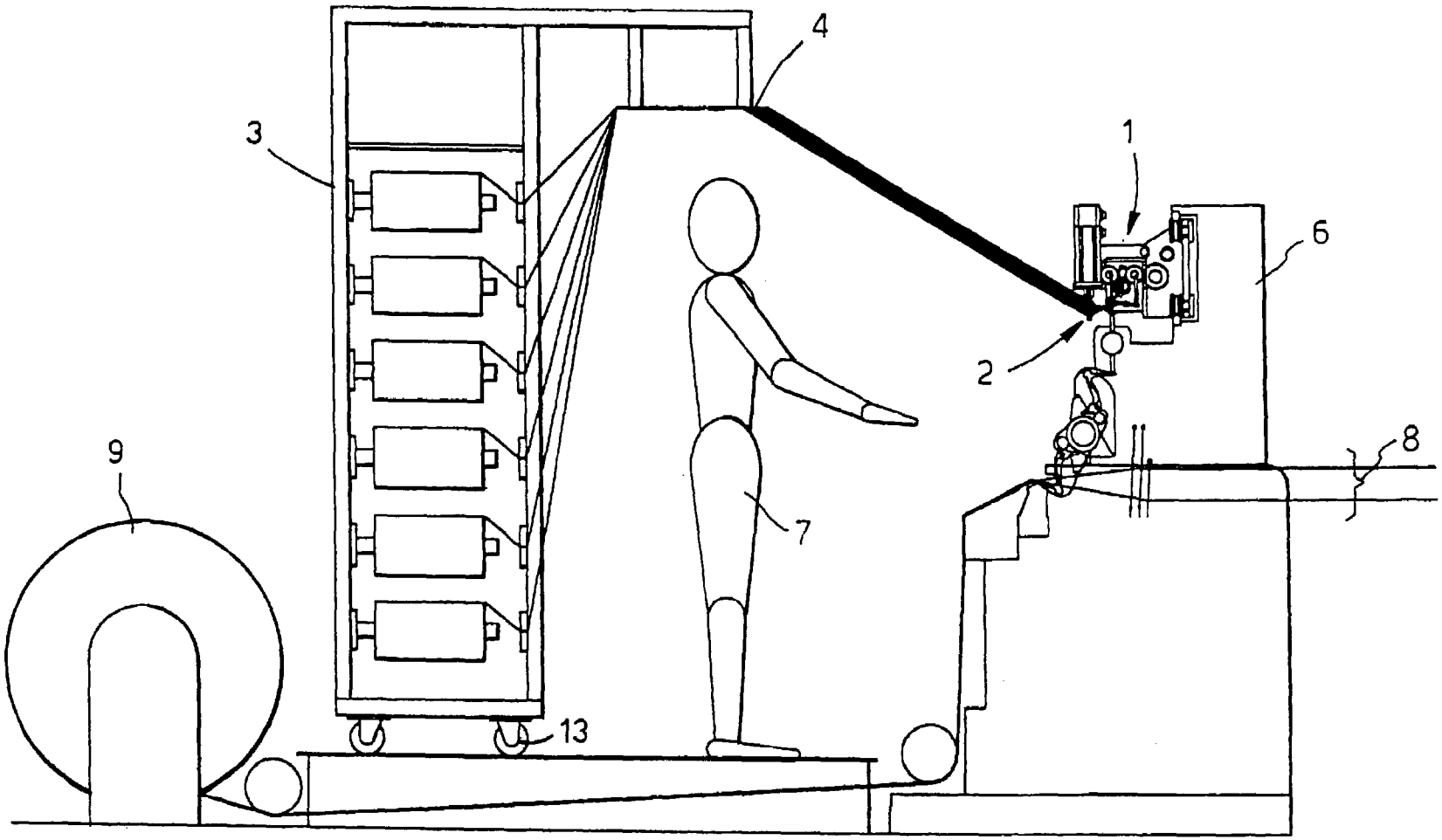
FIG. 1 is a partly sectioned side elevation of the loom.

A carpet weaving loom comprises one or more tuft forming units 1 each of which supplies yarn tufts to a number of different weaving points and each of which includes a demountable yarn carrier 2, a movable creel 3 for holding supplies of yarn, and guides 4 to guide yarn from a supply 5 on the creel 3 to the or each yarn carrier 2, in which the or each demountable yarn carrier 2, creel 3 and guides 4 are removable from the remainder of the loom 6 and replaceable when the design of carpet to be woven changes. The creel 3 is located in the front of the loom and behind the weavers position 7. This is on the opposite side of the loom from the warp beam (not shown) from which the warp threads 8 are provided. The completed carpet is collected on a roll 9.

Figure 2:
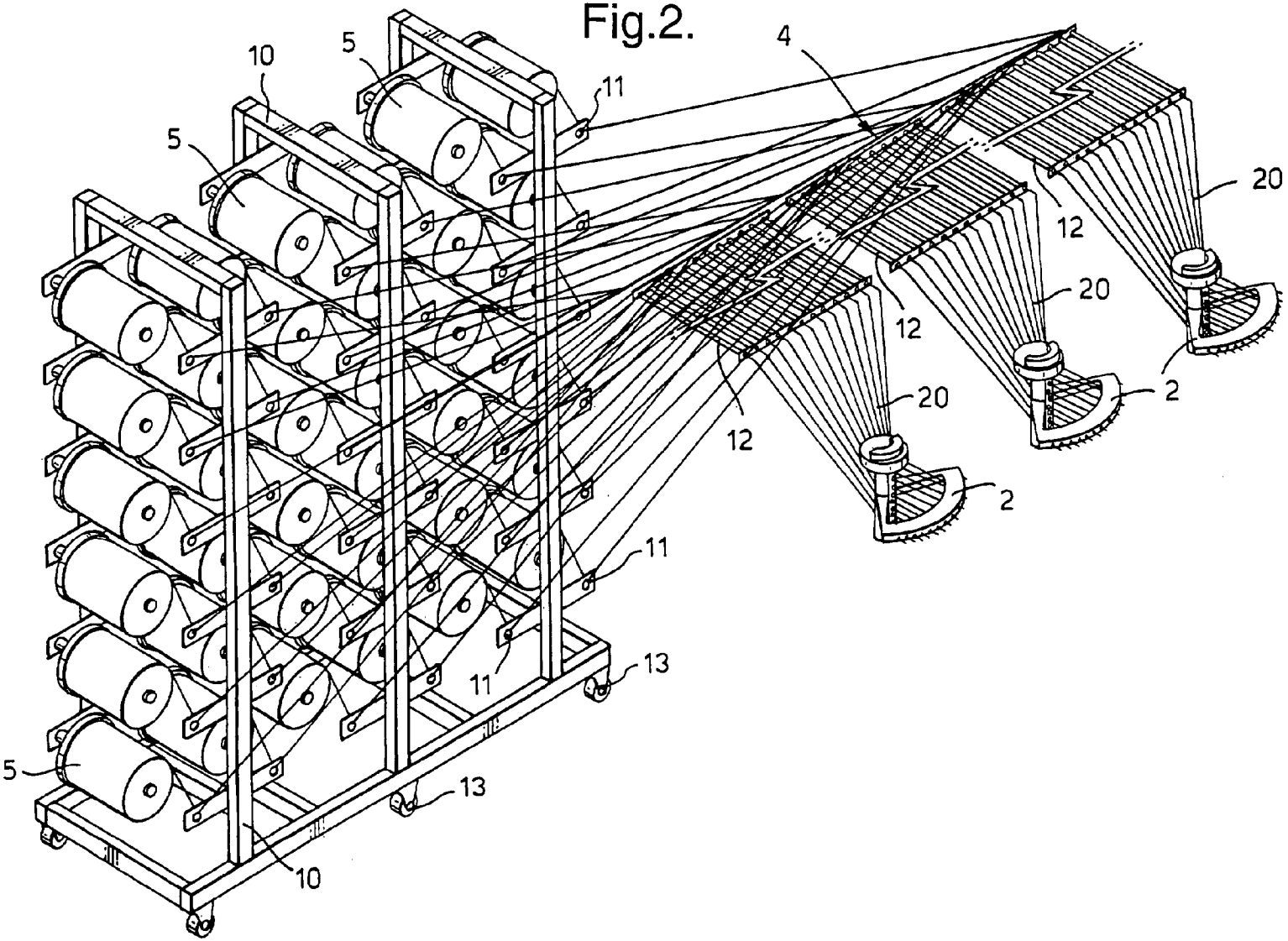
FIG. 2 is a schematic isometric view of the yarn supply path of a first example.

In the first example of yarn supply path the creel typically contains several stands 10 each containing a number of yarn packages 5. The arrangement shown in FIG. 2 shows each stand containing twelve yarn packages 5. Yarn from each package 5 is threaded via eyes 11 to a further guide arrangement 4 which consists of conventional yarn tubes 12 as shown in FIG. 2 passing over the weaving position 7. However these tubes 12 may be replaced by further eyes 11. Apart from containing many fewer packages and being formed so that the creel 3 is moveable, this example of creel 3 is otherwise conventional in construction. As shown the creel 3 is typically mounted on wheels 13 so that it can be moved manually towards and away from the remainder 6 of the loom.

Figure 3:
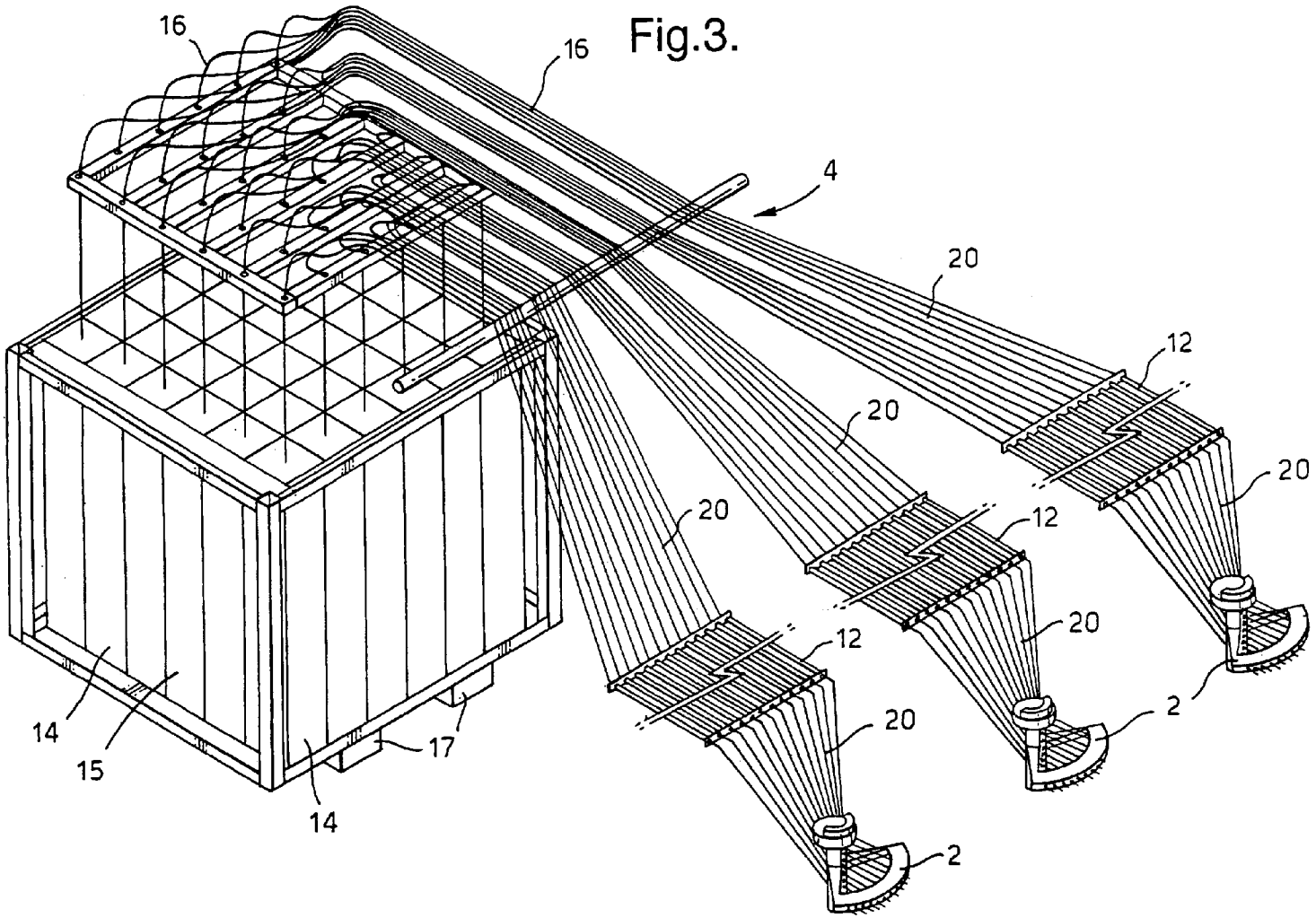
FIG. 3 is a schematic isometric view of the yarn supply path of a second example.

The second example of yarn supply is shown in FIG. 3 and is based on the type of yarn supply creel described fully in EP-A-0058478. In this arrangement a number of rectangular containers 14 are arranged to form a rectangular array 15. FIG. 3 merely illustrates a simple 6×6 array for the purposes of illustration but the array 15 may include more. Each container 14 includes a premeasured length of yarn. The yarn from each container 14 is threaded through yarn tubes 16 and then through yarn tubes 12 passing over the weavers position 7 to the demountable yarn carriers 2. The array 15 of containers 14 may be mounted on wheels, but, in this example it is intended to be moved into and out of position against the loom by a fork lift truck. Accordingly, its base includes feet 17 arranged to accommodate the lifting forks of a fork lift truck (not shown).

Figure 4:
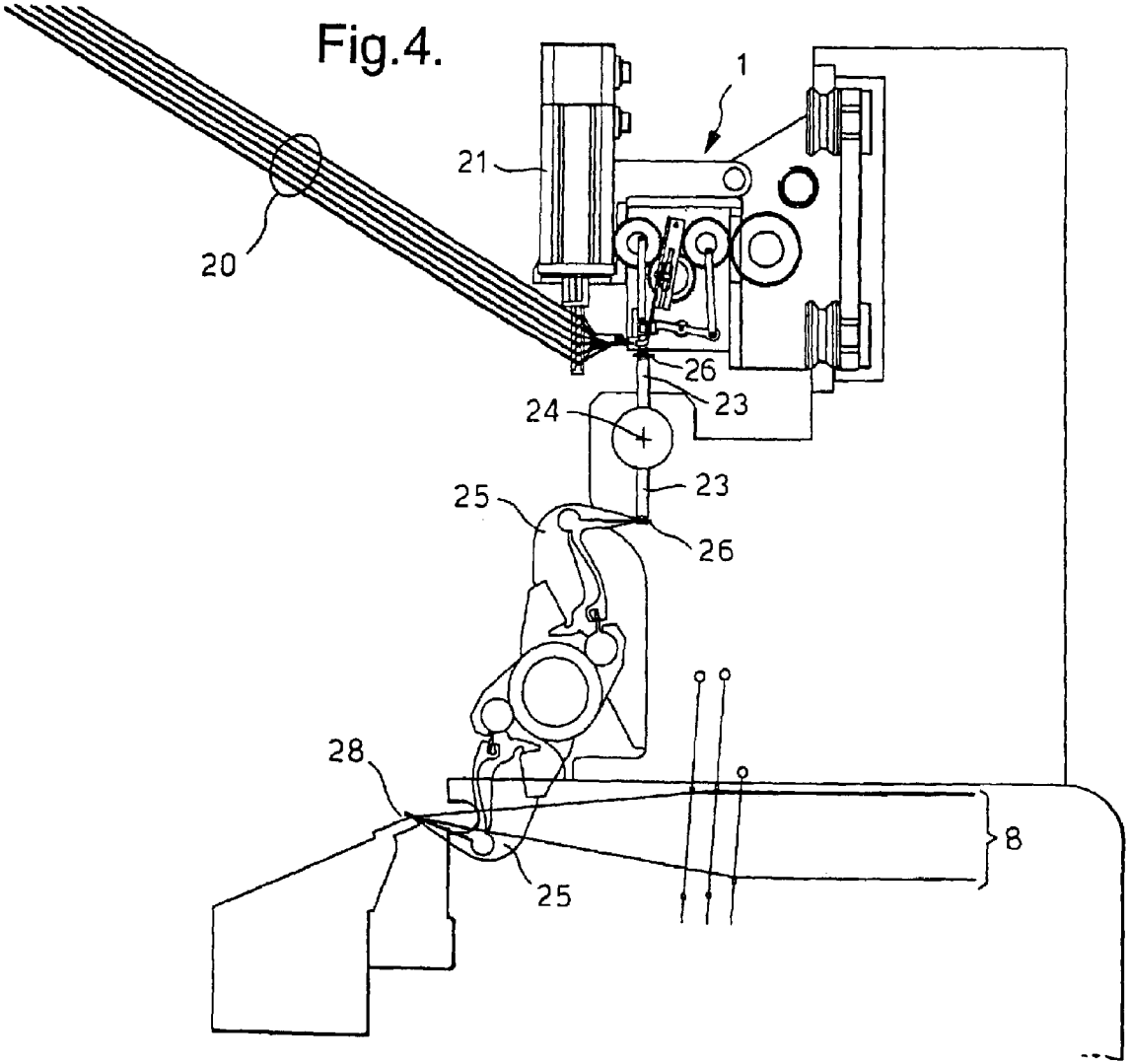
FIG. 4 is a sectional side elevation of the main weaving part of the loom.
Figure 5:
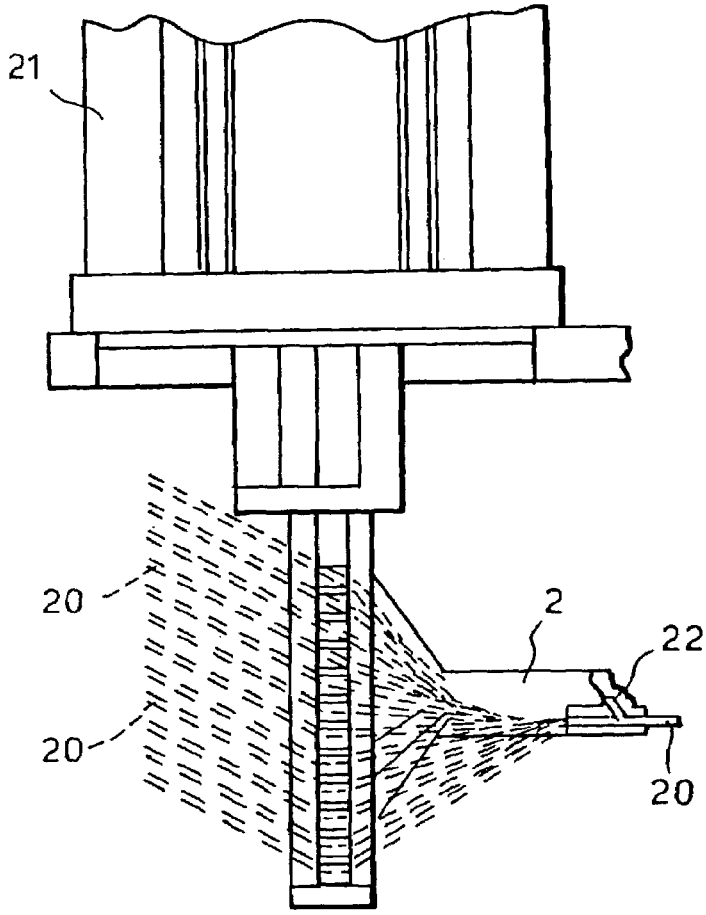
FIG. 5 is a partly sectioned view of part of the tuft forming unit.
Figure 6:
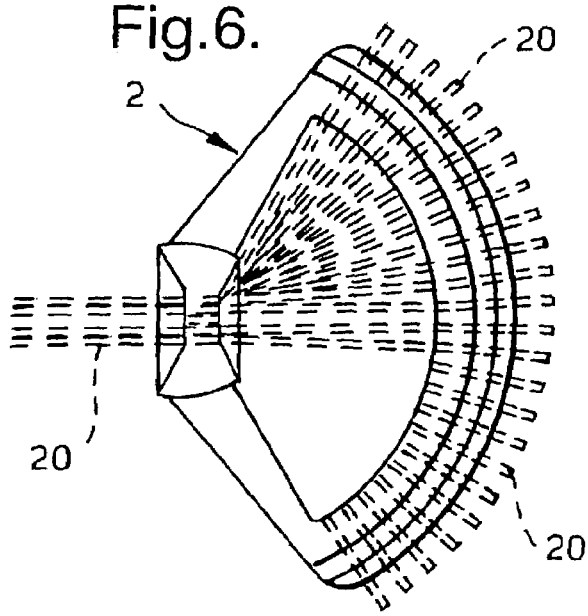
FIG. 6 is a plan view of the selector wheel.

The loom includes one or more tuft forming units 1, each of which includes a yarn selector wheel 2 which typically holds 12 or 24 yarns 20 of different colour. The yarn selector wheel 2 is detachably mounted onto a yarn selector motor 21 which rotates the selector wheel 2 into one of a number of angularly discreet positions to select yarn of a predetermined colour. As can be seen from FIG. 6 the yarns 20 of different colour are all arranged generally radially around the selector wheel 2 in generally radially extending channels and are held in place by springs 22. The loom includes a pair of tuft carriers 23, mounted for rotation about an axis 24 and a set of grippers 25 that are entirely conventional in construction and use. As the tuft forming units 1 traverse the loom in the forwards direction, tufts 26 are placed in tuft retention sites 27 (shown in FIG. 9) formed along the top edge of the tuft carrier 23. When all of the tuft retention sites 27 have been loaded, the tuft carrier 23 rotates clockwise (as seen in FIG. 4) about the axis 24 to move the loaded tuft carrier 23 into the lowermost position and to move an empty tuft carrier 23 into the uppermost position. The tuft forming units 1 then load tufts 26 into the uppermost tuft carrier 23 as they traverse backwards across the loom.

The grippers 25 move upwards, clockwise as seen in FIG. 4, with their beaks open and then close to grip all of the tufts 26 held by the lowermost tuft carrier 23. The grippers 25 then rotate in the opposite direction to move the tufts 26 to the weaving point 28 where the tufts 26 are woven into the carpet and the grippers 25 open to release the tufts 26. The beat up reeds and rapier weft insertion mechanism have been omitted from FIG. 4 for clarity but are entirely conventional and similar to those used on conventional gripper Axminster carpet looms.

Figure 7:
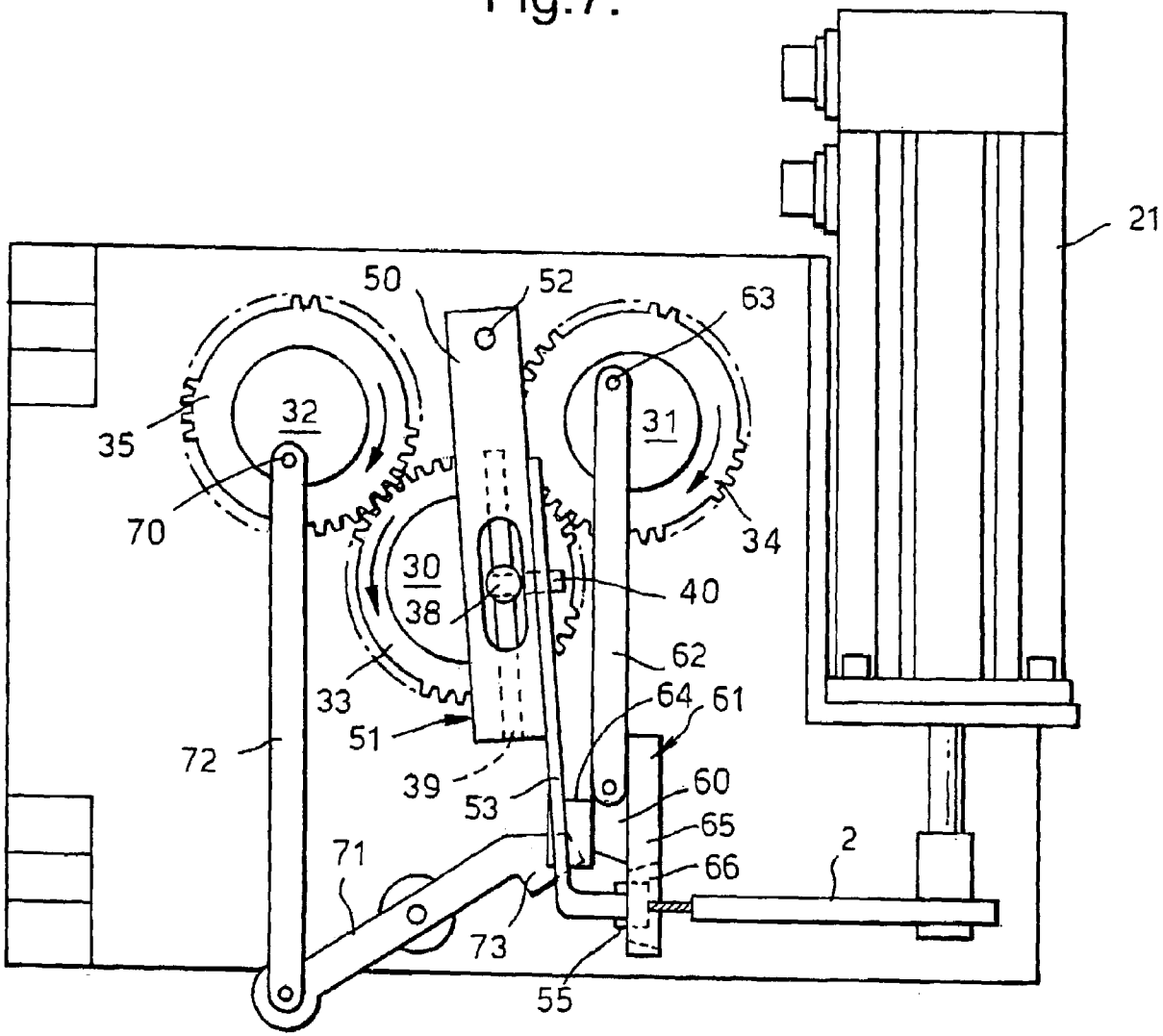
FIG. 7 is a diagrammatic view of the tuft forming unit at the start of the tuft forming operation.
Figure 8:
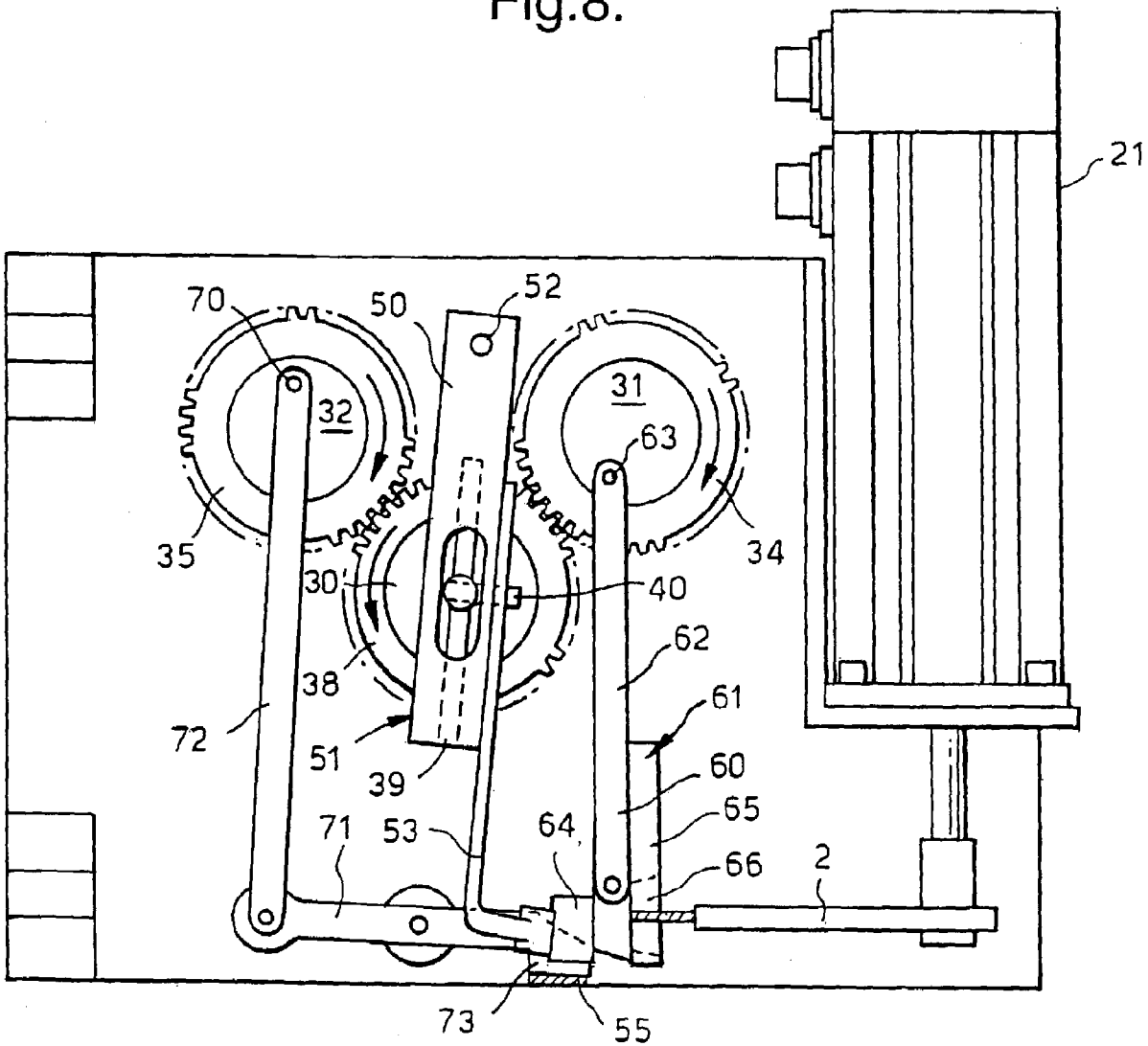
FIG. 8 is a diagrammatic view of the tuft forming unit at the end of the tuft forming operation.
Figure 9:
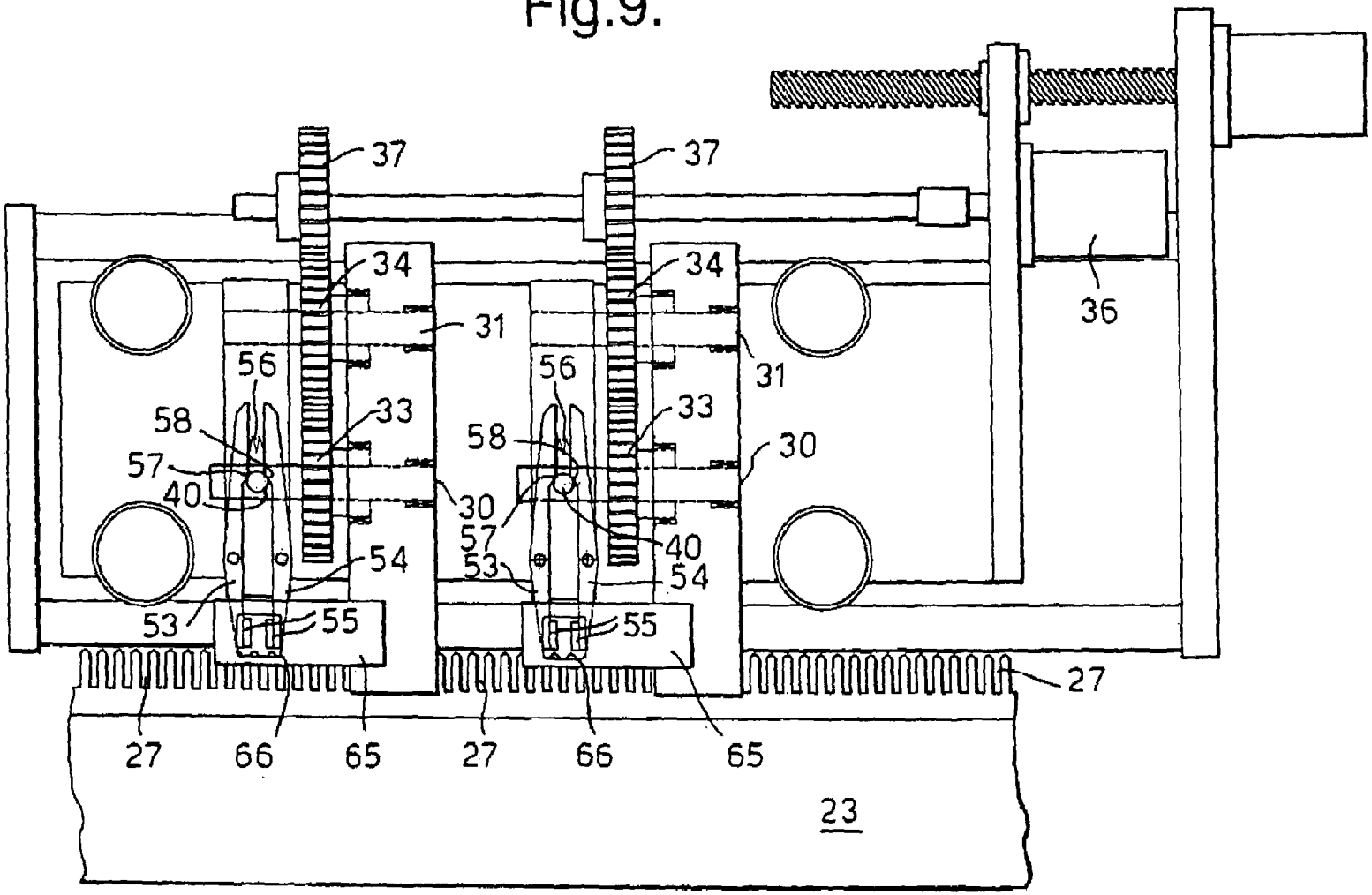
FIG. 9 is a simplified front elevation of two tuft forming units.

The tuft forming unit 1 is shown in simplified form for ease of explanation in FIGS. 7 to 9 and provides positive handling of each yarn tuft 26 during its formation and upon insertion into each tuft holding site 27 on yarn carrier 23. Each yarn tuft forming unit 1 includes a gear box which consists of three parallel shafts 30, 31, 32 on which are mounted three equal sized pinions 33, 34, 35 which are meshed together. One of the shafts 30, 31, 32 is driven directly by a servomotor 36 and a further pinion 37 as shown in FIG. 9. All three shafts 30, 31, 32 are drilled to carry eccentric pins. Pin 38 is mounted in shaft 30 and is connected to rod 39 and pin 40. Rod 39 is journalled into body 50 of puller 51 so that it can slide up and down as seen in FIGS. 7 and 8. The body 50 is pivoted at its upper end on pivot 52. Consequently, as shaft 30 rotates, counterclockwise as seen in FIG. 7, the pin 38 and rod 39 move up and down with respect to the body 50 and the body 50 is caused to pivot backwards and forwards about its pivot 52. The puller 51 includes a pair of pivoted limbs 53,54 with jaws 55 mounted at their lowermost ends. The upper ends of the limbs 53,54 are urged together by a spring 56 to cause the limbs to pivot and open the jaws 55. The pin 40 moves up and down with respect to cam surfaces 57,58 on the limbs 52,53 to urge the jaws 55 together when in its uppermost position and, in its lowermost position, allow the limbs 52,53 to respond to the bias exerted by the spring 56, to open the jaws 55.

A moveable blade 60 of a knife assembly 61 is driven up and down by a link 62 connected between the moveable blade 60 and an eccentric pin 63 mounted in the shaft 31. The rear face of the moveable knife blade carries a pair of guide cheeks 64 which locate between the limbs 52,53 when they are in their forwards position. A fixed knife blade 65 includes an aperture 66 adjacent the edge of the selector wheel 2 and into which the yarn ends protrude. An eccentric pin 70 in the third shaft 32 drives one end of a first order lever 71 via a link 72. A pusher 73 located at the other end of the first order lever 71 moves up and down between the guide cheeks 64.

To produce each tuft, the yarn selector motor 21 rotates the selector wheel 2 to bring the selected yarn to a location adjacent the puller 51. The body 50 of the puller is pivoted forwards with the pin 40 towards its lowermost position so that the jaws 55 are open. As the shaft 30 continues to rotate the pin 40 lifts and is moved between the cam surfaces 57,58 so closing the jaws 55 and clamping the free end of the selected yarn between them. Further rotation of the shaft 30 causes the body 50 of the puller 51 to pivot backwards so pulling yarn through the selector wheel 2 and from the creel 3. Rotation of shaft 31 causes the moveable blade 60 of the knife assembly 61 to move downwards. As the blade 60 moves downwards the length of yarn being pulled by the puller 51 is trapped between the guide cheeks 64. Once the puller 51 has moved backwards to its maximum extent the continued downwards movement of the knife blade 60 cuts the yarn to form a tuft 26 which is held between the guide cheeks 64 as the knife blade 60 continues to move downwards on an overtravel. Meanwhile rotation of shaft 32 causes the pusher 73 to move downwards between the guide cheeks 64. Further rotation of shaft 30 causes the pin 40 to be lowered away from the cam surfaces 56,57 so that the jaws 55 open under the action of the spring 56. Further rotation of the shaft 32 brings the pusher 73 into contact with the top of the tuft 26 held between the guide cheeks 64 and continued rotation of the shaft 32 causes the tuft 26 to be pushed into a tuft retention site 27 on the tuft carrier 23. Continued rotation of the shaft 31 moves the moveable knife blade 60 upwards. Meanwhile the yarn selector motor 21 moves the selector wheel 2 to bring the next yarn to be selected into position. Continued rotation of shafts 30 and 32 move the puller 51 forwards into position to grip the next yarn and move the pusher 73 upwards ready for the next cycle of operation.

Figure 10:
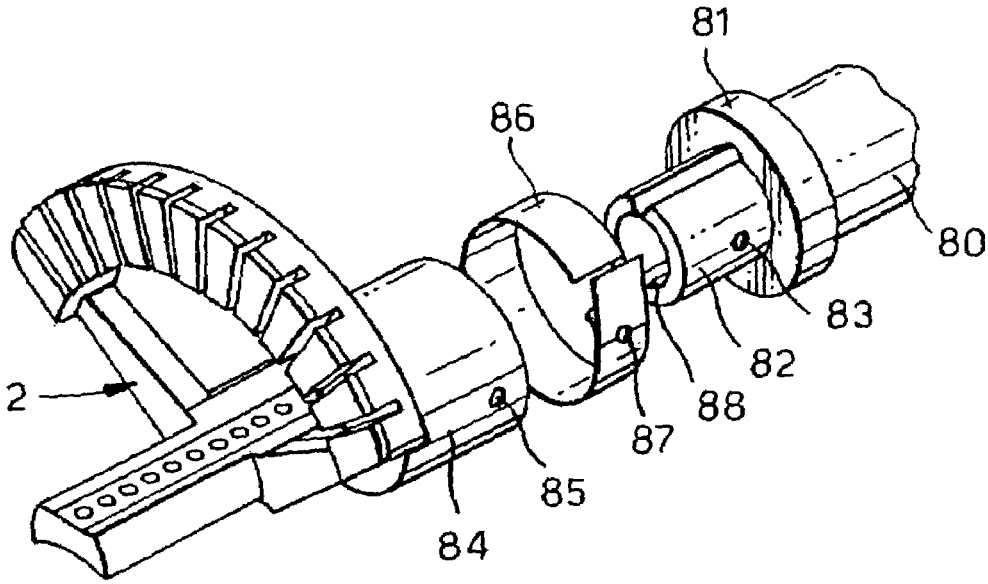
FIG. 10 is an exploded isometric view showing a first example of interconnection between the yarn selector wheel and the yarn selector motor.

FIG. 10 shows one example of the demountable connection between the selector wheel 2 and the yarn selector motor 21. In this example the selector motor 21 drives a shaft 80 which includes a collar 81 and further keyed shaft 82. It also includes a radial bore 83. A head 84 of the selector wheel 2 includes a female recess to accept the keyed shaft 82 and also includes a radial bore 85. A generally circular leaf spring 86 carries a radially extending pin 87. The spring 86 is normally fitted onto the head 84 of the selector wheel 2 with the pin 87 being inserted into the bore 85.

To fit the selector wheel 2 onto the shaft 80 the head 84 of the selector wheel 2 is merely pushed onto the end of the keyed shaft 82 and rotated until their matching key ways slide together. Then, a free end 88 of the spring is raised to move the pin 87 radially outwards to allow the head 84 to slide along the keyed shaft 82 until it comes to rest against the collar 81. Releasing the free end 88 of the spring 86 then allows the pin 87 to pass onto the bore 83 to lock the selector wheel 2 into position on the shaft 80 of the selector wheel motor 21. To remove the selector wheel to the operator merely lifts the free end 88 of the spring 86 to disengage the pin 87 from the bore 83 and then pulls the selector wheel off the keyed shaft 82.

Figure 11:
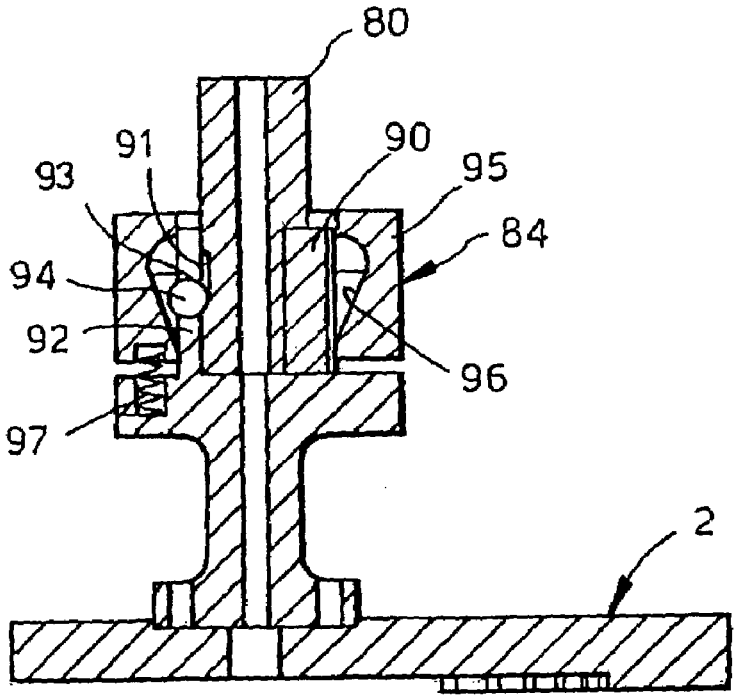
FIG. 11 is a vertical section through a second example of interconnection between the yarn selector wheel and the yarn selector motor.

A second example of interconnection is shown in FIG. 11. Again the shaft 80 of the selector wheel motor 21 includes a key 90 located in a key-way cut in the shaft 80. The shaft 80 also includes an annular groove 91. The selector wheel 2 includes a head portion 84 having a sleeve 92 which fits around the shaft and key 90. The sleeve 92 includes three tapered apertures 93 each of which locates a ball 94. A collar 95 having an internal tapered surface 96 surrounds the sleeve 92 and is urged away from the selector wheel 2 by three compression springs 97. The internal tapered surface 96 of the collar 95 contacts the outer surface of the balls 94 and urges them radially inwards so that they engage the groove 91 in the shaft 80 of the selector motor 21. Thus, the selector wheel 2 is prevented from rotating with respect to the shaft 80 by the inter-engagement of the key 90 and the key-way, and is held in place by the balls 94 engaging in the annular groove 91.

To remove the selector wheel 2 the collar 95 is merely pushed downwards, as shown in FIG. 11, against the bias of the springs 97, which then allows the balls 94 to move radially outwards, out the groove 91, so that the head 84 of the selector wheel 2 can be simply slid downwards off the shaft 80. Similarly, to replace the selector wheel 2 the head is simply rotated until the key 90 and key way are aligned and then the head 2 is simply pushed upwards into position, whilst holding the collar 95 depressed against the bias of the springs 97. Upon releasing the pressure on the collar 95 the springs 97 urge the collar 95 upwards and this, in turn, urges the balls 94 radially inwards so that they lock into the annular groove 91.

What is claimed is:

1. A carpet weaving loom comprising one or more tuft forming units (1), each of which is capable of supplying yarn tufts (26) of a number of different colours to a number of different weaving points sequentially, characterized in that the or each of the tuft forming units (1) includes a demountable yarn carrier (2), in which the or each yarn carrier (2) is demountable from the remainder of the or each tuft forming unit (1) without the use of tools of any kind and in which the yarn carrier (2) includes engagement means (82, 90) which cooperate with a drive means (21) to drive the yarn carrier (2) to ensure that the yarn carrier responds to movement of the drive means (21) and a retainer (83, 87, 91, 94) to hold the yarn carrier (2) in position.

2. A carpet weaving loom according to claim 1, in which the retainer is a simple press-on or snap-on fitting or, alternatively, the retainer includes a positive lock or latch operable to lock the yarn carrier into position.

3. A carpet weaving loom comprising one or more tuft forming units (1), each of which is capable of supplying yarn tufts (26) of a number of different colours to a number of different weaving points sequentially, characterized in that the or each of the tuft forming units (1) includes a demountable yarn carrier (2) which is supplied with yarn from a creel (3) which is itself removable from the remainder of the loom and replaceable when the design of carpet to be woven changes or the creel (3) is exhausted.

4. A carpet weaving loom according to claim 3, in which the creel (3) is mounted on wheels (13) so that it can be wheeled towards the way from the remainder of the loom, typically manually.

5. A carpet weaving loom according to claim 4, in which guides (4) attached to and moving with the creel (3) are provided to guide the yarn from the creel (3) to the or each demountable yarn carrier (2).

6. A carpet weaving loom comprising one or more tuft forming units (1), each of which is capable of supplying yarn tufts (26) of a number of different colours to a number of different weaving points sequentially, characterized in that the or each of the tuft forming units (1) includes a demountable yarn carrier (2), wherein the yarn supplies for the or each demountable yarn carrier (2) are provided from a creel (3) which is fixed in position and formed in two parts; yarn from one part being threaded through guides and into all of the one or more demountable yarn carriers (2) associated with the tuft forming units (1) on the loom, so enabling the or each of the demountable yarn carriers (2) to be removed from the loom and replaced by different yarn carriers (2) which are all fed from yarn in the other part of the creel (3), when it is required to change the design of carpet to be woven, or when the creel (3) is exhausted.

7. A carpet weaving loom according to claim 6, in which the creel (3) is located behind a weaver (7) and on the opposite side of the loom from a warp thread entry (8) and shedding arrangements.

8. A carpet weaving loom according to claim 7, in which guides (4) carry the yarn over the top of the weaver's position (7), and the guides are formed by a series of yarn tubes (12).

9. A carpet weaving loom according to claim 6, in which includes a number of package holders each of which supports a bobbin (5) of a conventional yarn package or, alternatively, a creel includes a number of individual containers or cells (14) each of which contains a length of yarn.

10. A carpet weaving loom according to claim 3, in which guides (4) attached to and moving with the creel (3) are provided to guide the yarn from the creel (3) to the or each demountable yarn carrier (2).

11. A carpet weaving loom according to claim 3, in which the creel (3) is located behind a weaver (7) and on the opposite side of the loom from a warp thread entry (8) and shedding arrangements.

12. A carpet weaving loom according to claim 11, in which guides (4) carry the yarns over the top of the weaver's position (7), and the guides are formed by a series of yarn tubes (12).

13. A carpet weaving loom comprising one or more tuft forming units (1), each of which is capable of supplying yarn tufts (26) of a number of different colours to a number of different weaving points sequentially, characterized in that the or each of the tuft forming units (1) includes a demountable yarn carrier (2) and the carpet weaving loom further includes a number of package holders each of which supports a bobbin (5) of a conventional yarn package or, alternatively, a creel includes a number of individual containers or cells (14) each of which contains a length of yarn.

14. A carpet weaving loom comprising one or more tuft forming units (1), each of which is capable of supplying yarn tufts (26) of a number of different colours to a number of different weaving points sequentially, characterized in that the or each of the tuft forming units (1) includes a demountable yarn carrier (2) and in which yarn supplies on a creel (3) are all of a predetermined length and matched to those required for the particular design of carpet to be woven.

15. A carpet weaving loom comprising one or more tuft forming units (1), each of which is capable of supplying yarn tufts (26) of a number of different colours to a number of different weaving points sequentially, characterized in that the or each of the tuft forming units (1) includes a demountable yarn carrier (2), and in which the or each yarn tuft forming unit (1) includes means (21) to drive the yarn carrier (2) into a selected one of a number of discrete positions to bring a selected yarn (20) to a loading position, a puller (51) for engaging the selected yarn (20) at the loading position and pulling a predetermined length of the selected yarn (20) from the selector wheel (2), and a cutting mechanism (61) to cut the selected yarn (20) to form a tuft (26) of predetermined length.

* * * * *